US007249629B2

(12) United States Patent
Cunningham et al.

(10) Patent No.: US 7,249,629 B2
(45) Date of Patent: Jul. 31, 2007

(54) MULTI-FUNCTION WELL SERVICING VEHICLE

(75) Inventors: Brian Cunningham, Sylvan Lake (CA); Dave Johanson, Sylvan Lake (CA); Duncan McPhedran, Calgary (CA); Bill Darling, Calgary (CA); Barry Goss, Bragg Creek (CA); Ilya Mayzus, Calgary (CA); Gary Eirich, Medicine Hat (CA); Rudy Slaney, Brooks (CA)

(73) Assignee: Big Guns Perforating and Logging Inc., Calgary, Alberta (CA)

( * ) Notice: Subject to any disclaimer, the term of this patent is extended or adjusted under 35 U.S.C. 154(b) by 353 days.

(21) Appl. No.: 11/086,398

(22) Filed: Mar. 23, 2005

(65) Prior Publication Data

US 2006/0213653 A1 Sep. 28, 2006

(51) Int. Cl.
*E21B 19/22* (2006.01)

(52) U.S. Cl. ..... 166/77.1; 166/77.51; 175/135

(58) Field of Classification Search ..... None
See application file for complete search history.

(56) References Cited

U.S. PATENT DOCUMENTS 2,847,098 A * 8/1958 Heinish ..... 52/118
3,109,523 A * 11/1963 Moller ..... 52/115
3,670,831 A * 6/1972 Winter et al. ..... 175/52
3,734,210 A * 5/1973 Wilderman ..... 175/85
3,994,350 A * 11/1976 Smith et al. ..... 175/85
4,371,046 A * 2/1983 Read ..... 175/57
4,478,291 A * 10/1984 Futros ..... 173/147
5,094,302 A * 3/1992 Back ..... 173/28
5,794,723 A * 8/1998 Caneer et al. ..... 175/85
6,003,598 A * 12/1999 Andreychuk ..... 166/76.1

* cited by examiner

*Primary Examiner*—Frank Tsay
(74) *Attorney, Agent, or Firm*—Gowling Lafleur Henderson LLP; D. Doak Horne

(57) ABSTRACT

A mobile vehicle for inserting jointed pipe into a well, having a derrick and hydraulic rams to raise and lower same, adapted to conduct additional operations which will allow a well to be completed by this vehicle alone. Three winches are provided, a first to raise and lower power tongs to manoeuvre and thread jointed pipe, a second situate on the bed of the vehicle to raise and lower jointed tubing, and a third likewise mounted on the bed of the vehicle on which a conductive wireline is wound, for raising and lowering logging and swabbing devices in the well. Levelling jacks are provided at four corners of the vehicle to permit levelling of the vehicle and alignment of jointed pipe with the borehole of the well. Each of the rams, power tongs, levelling jacks, first, second, and third winches are hydraulically powered, preferably by a single pump, as each of the aforementioned devices are not operated at the same time but sequentially.

13 Claims, 9 Drawing Sheets

MULTI-FUNCTION WELL SERVICING VEHICLE

FIELD OF THE INVENTION

The present invention relates to equipment for completing and servicing oil and gas wells, and in particular relates to a multi-function mobile rig vehicle capable of carrying out a number of well completing and servicing tasks, including the insertion of jointed (but not continuous) pipe into said wells.

BACKGROUND OF THE INVENTION AND DESCRIPTION OF THE PRIOR ART

Typically, when an oil or gas well has been drilled, a number of further steps are required to complete the well to ready it for production. A logging operation, a swabbing operation, and an operation involving insertion of pipe or tubing into the well, and finally a perforation step to perforate said tubing, typically are additional steps required to ready a well for production.

The logging step requires the lowering of a logging instrument into the drilled well. The logging instrument is an elongate cylindrical device that is typically lowered from a well-servicing vehicle via an electrically-conductive wireline (referred to in the well completion and servicing industry as an "e-line") into the drilled well. The logging device emits gamma rays or the like and is used to receive reflected waves from the petroleum formation, such reflected waves indicating physical properties of rock formation in which the well is drilled useful for determining whether further steps, such as whether fractionation of the petrochemical formation in which the well lies, would be needed or beneficial. Information and data from the logging instrument is relayed to the surface of the well via the wireline, and the data is "logged" by means of recording instrumentation, typically situate in the service vehicle at the surface of the well. The logging instrument is thereafter brought to the well surface by the wireline, which is wound on a winch expressly provided on the service vehicle for this purpose.

The step of swabbing a well involves the removal of water which may be in the well, to permit the flow of petroleum from the formation into the well. Such swabbing operation involves the lowering, by means of another wireline, typically a high strength cable, of a plug which has a valve thereon. The plug is lowered in the well, with the water in the well flowing through the valve from the underside of the plug to the upperside of the plug, thereby allowing the plug to settle towards the bottom of the well. Thereafter, the valve closes when the plug is raised. In such manner the raising of the plug allows water above the plug to be removed from the well when the plug is withdrawn, so as to thereby "underbalance" the well and permit its later use in oil or gas recovery. The swabbing operation frequently needs to be carried out a number of times in order that the well be as underbalanced as possible.

After a well is drilled, the well is typically cased with metal tubing or piping so as to prevent inadvertent closure of the well due to shifting or collapse of surrounding strata, and to permit the pumping, in the case of oil, or the pressurized flow of gas, in the case of natural gas, from the well. This step is a further step necessary to complete a well and ready it for production.

In this tubing insertion step, the tubing which is inserted into the well may be continuous tubing, which is typically used in deeper wells (in excess of 1,500-2,000 meters), or in the case of shallow wells, joined pipe is used which provides slightly higher resistance to fluid flow due to the pipe joints, but which is tolerable in shallower wells. Any tubing, regardless of whether continuous or joined pipe, must be perforated at the lowermost extremity of the well, to allow oil or gas to flow into the tubing at the lowermost portion of the well, and thereafter flow up and out of the well via the upper tubing.

Accordingly, the final step in completing a well, typically after logging and swabbing have been carried out, involves the lowering, by means of a conductive wireline, of an explosive charge situated on the lowermost end of the inserted tubing. Such tubing-conveyed charge is then, when substantially all of the tubing been inserted into the well, detonated at the lowermost portion of the well (i.e. the producing portion of the well), to permit gas or oil to flow through into the resulting holes (perforations) in the tubing/casing, and thereby permit the oil or gas, as the case may be, to flow up or be drawn up to the surface of the well via the unperforated tubing now above. This procedure is typically known in the art as TCP ("tubing conveyed perforation").

Each of the above steps is typically needed to be conducted in order to bring a drilled well into production.

Mobile rigs for the drilling of wells are well known in the art, such as those disclosed in U.S. Pat. Nos. 2,847,098, 3,109,523, 3,670,831, 3,734,210, 3,994,350, 4,371,046, 4,478,291, 5,094,302 and 5,794,723.

Typically, these prior art drilling rigs are relatively large and heavy, particularly where they are adapted for drilling deeper wells (i.e. wells of more than 1500 to 3000 m in depth).

In the prior art, due to the size and complexity of the above prior art drilling rigs, these units are usually only adapted for the drilling of the well. Lighter, less complex, "rigless" well servicing equipment, which cannot drill but which can carry out one or more steps in the completing of the well, such as the logging and/or swabbing operations, are typically employed for these purposes.

One such example of a prior art "rigless" well service vehicle is the "first generation" mobile servicing vehicle manufactured by Big Guns Perforating and Logging Inc. of Calgary, Alberta, Canada, who is also the assignee of this invention described later herein. Such mobile vehicle essentially consists of a double-axle vehicle, the rear bed thereof having a chain-driven winch having a 9/16 inch cable wound thereon for carrying out swabbing operations, and a further drum having a 5/16 inch conductive wireline wound thereon, used for lowering a logging instrument for logging operations. Such vehicle further carried on the bed thereof computerized equipment for "logging" and analyzing the data received from the logging instrument via the 5/16 inch conductive wireline.

This prior art vehicle, while useful, was recognized as being more practical if it could further carry out TCP (tubing conveyed perforation), so that the drilling vehicle which possessed a rig or derrick to permit drilling as well as insertion of tubing into the well would not need to be manoeuvred back over the well to insert the tubing after the logging operations had been done by the service vehicle. In other words, it was recognized that it would be more economical if the Big Guns service vehicle could conduct all of the steps of logging, swabbing, tubing insertion and perforation, so that immediately after drilling the well the drilling rig could permanently depart from the well site to other locations where its valuable services are needed, and leave the task of completion of the well to a service vehicle.

Accordingly, to this end, a mast was further added to the first generation service vehicle made by Big Guns Perforating and Logging Inc., which, by having a mast of at least 30 feet in height, could permit the insertion of 30 foot lengths of jointed pipe into the well to complete TCP. These "second generation" service vehicles then properly became a service rig, in that they then possessed a mast, pivotably coupled to the bed of the vehicle, which could be raised by hydraulic pistons to a substantially vertical or slightly over-vertical position. To stabilize the mast/derrick when in a raised position, such vehicles had manual telescoping stabilizing jacks proximate each of the left, right, front, and back corners of such vehicle, to prevent tipping.

Disadvantageously, however, such "second generation" service rig vehicles needed at least one additional service vehicle having auxiliary equipment such as hydraulic power tongs for the power handling and threading of jointed pipe during the TCP operation. This auxiliary equipment was typically supplied by another service vehicle having such equipment on the rear bed thereof, which provided such function when it likewise was backed up to the well, typically opposite the service rig vehicle, so that workers could utilize the service rig to hold the pipe, and the hydraulic power tongs on the additional service vehicles to thread the joined pipe together for insertion into the well.

As an attempt to design a vehicle which could provide a number of well completion steps, U.S. Pat. No. 6,003,598 teaches a mobile vehicle/carrier 22 having a collapsible mast or derrick 40 which may be hydraulically raised and lowered by means of hydraulic pistons 52. A winch 46 and cable is provided proximate the crown of the derrick 40 for performing functions such as manipulating joined pipe segments if required. A further wireline winch assembly 100 and a drum 102 having a conductive wireline wound thereon allows a logging instrument to be lowered into the well to permit logging and vertical wells.

The vehicle/carrier 22 disclosed in U.S. Pat. No. 6,003,598 possessed stabilizers 32 at each corner, incorporating a vertically extendible hydraulic jack or lifter 34 for engaging the ground 21, to level the rig as desired during operation, thereby removing some or all of the rig's weight from the front and/or rear axles 26,28. A platform 47 was further provided, movable from a retracted position to an operable position by a fastline winch 49 situate proximate the crown of the derrick 40. Notably, platform 47 was permanently affixed to the derrick 40 (ref. FIG. 5) at a fixed height, and travelled with the vehicle 22.

Importantly, vehicle 22 of U.S. Pat. No. 6,0003,598 was adapted for injecting continuous tubing (CT). As such, it possessed a large removable reel 82, part of a cartridge assembly 80, on which CT was wound. An injector 70, slidable on the derrick 40 by means of winch 46, was provided, for injecting the continuous tubing in the well, was also necessary.

While U.S. Pat. No. 6,003,598 discloses that it may be used for manipulating joined pipe (as opposed to CT) if need be, and indeed discloses winch 46 for such purpose, disadvantageously vehicle 22 of U.S. Pat. No. 6,003,598 clearly is poorly suited to insertion of jointed pipe. In particular, such vehicle 22 for effective use in inserted jointed (as opposed to continuous pipe) required another service vehicle having power tongs to mechanically join pipe segments together, as it clearly lacked any such equipment. In particular, for shallower wells, where jointed pipe instead of CT is typically used, to carry out manipulation of jointed pipe would require disengagement of winch 46 with injector 70, as injector 70 was not needed, in order to allow derrick-mounted winch 46 to handle jointed pipe. However, all that winch 46 of U.S. Pat. No. 6,003,598 can do is raise and lower jointed tubing—no power mechanism other than winch 46 is disclosed in U.S. Pat. No. 6,003,598 to handle jointed pipe, nor could the derrick 40, due to the provision of slidable injector 70 on derrick 40, be adapted to provide such power tongs, as they would plainly interfere with the injector 70. Particularly, while U.S. Pat. No. 6,003,598 discloses that such carrier/vehicle 22 may also be used to insert jointed pipe into a well, derrick 40 with its sliding injector 70 clearly lacked the ability to provide upwardly and downwardly moveable power tools to allow power manipulation of jointed pipe, as the injector 70 would necessarily Interfere with such devices. At least one other service vehicle would be necessary to provide such capability.

Accordingly, the ability to insert jointed pipe in an efficient manner was not, nor capable of being, provided by vehicle 22 of U.S. Pat. No. 6,003,598. Accordingly, vehicle/carrier 22 of U.S. Pat. No. 6,003,598 suffered from the similar shortcoming of the second generation Big Guns vehicle, namely the need for other service vehicles having additional equipment to be present.

In addition, due to the provision of a large cartridge assembly 80 for CT injection and a sliding injector 70 on vehicle 22 of U.S. Pat. No. 6,003,598, as well as a platform 47 which was permanently mounted on vehicle/carrier 22 and transported with such vehicle 22, vehicle 22 was necessarily large and cumbersome.

Accordingly, there exists a real need in the industry for a single, multi-function well servicing vehicle for shallow wells, capable to not only conducting logging and swabbing operations, but also effectively and efficiently being able to insert joined pipe into the well. Also necessary is the ability to carry out tubing conveyed perforation, so as to be able to complete a pre-drilled well and ready it for production without the need for any other well servicing vehicles.

SUMMARY OF THE INVENTION

In order to provide a specialized well servicing vehicle capable of inserting jointed pipe in a pre-drilled well in a mechanized and efficient manner, but also being able to conduct at least one additional well completion step, in a first broad embodiment the present invention provides a mobile well servicing vehicle adapted to conduct insertion of jointed, but not continuous, pipe into a pre-drilled well, including conducting at least one additional well-servicing step selected from the group of well servicing steps consisting of logging, swabbing, and perforating, such vehicle possessing:

elongate mast means, having a top end and a bottom end, pivotably coupled to said vehicle proximate said bottom end, pivotable from a first substantially horizontal position to a second substantially vertical position;

engine means, for providing motive force for said vehicle via a transmission means;

hydraulic pump means, coupled to said engine means, said engine means providing operative power to said hydraulic pump means;

a hydraulic piston member, hydraulically coupled to said hydraulic pump means, for raising and lowering said mast means from said first position to said second position, and from said second position to said first position, respectively;

hydraulically-operated telescoping levelling members situate at respectively four substantially mutually opposite side corners of said vehicle, each hydraulically coupled to said hydraulic pump means;

a first hydraulically-powered winch means, hydraulically coupled to said hydraulic pump means, situate proximate said top end of said mast means, for raising and lowering, via a cable member, a hydraulically-operated grappling means suspended via said cable member from said mast means, said grappling means adapted to grasp and manipulate said jointed pipe, said grappling means hydraulically coupled to said pump means;

a second hydraulically-powered winch means, hydraulically coupled to said hydraulic pump means, having cable means wound thereon to permit lowering of said jointed pipe via said cable means into said well; and a third hydraulically-powered winch means, hydraulically coupled to said hydraulic pump means, having electrically conductive wire line means wound thereon, for lowering one or more devices selected from the group of devices comprising a well-logging device and a well swabbing device, via said wire line means, into said well.

Advantageously, it was realized by the within inventors that the steps of well servicing provided by the equipment of this vehicle are sequential steps, and typically do not overlap in time. Thus if all equipment was to be hydraulically powered, the hydraulic pressure needed to operate the various equipment need not be the sum of the required individual equipment pressures, but need only be the single maximum pressure needed to operate a single individual equipment. Thus it was realized that considerable weight-saving and cost saving can be accomplished by being able to use a single hydraulic pump, and further, one that is powered by the vehicle's engine and not by an on-board auxiliary motor. In addition, by providing all equipment be hydraulic, as opposed to having such equipment powered by mixed means (e.g. electrical, hydraulic, direct drive from auxiliary internal combustion motor, or combination thereof, additional cost and weight savings can be recognized by eliminating the need to provide an electrical generator or auxiliary internal combustion motor for some of the equipment, such as winches. Thus by using hydraulic power for each of the implements, and a single hydraulic pump to supply each of the equipment, namely the power tongs, hydraulic pistons, levelling jacks, and first, second and third winches, considerable cost and weight savings can be realized.

Accordingly, in a preferred embodiment, such hydraulic pump means comprises of single hydraulic pump.

In a further preferred embodiment of the present invention, provision is made for a working platform to be attached to the derrick when the derrick is positioned in its vertical operative position to provide a platform for workers to utilize power tongs to thread jointed pipe together for insertion into the well.

Accordingly, in such preferred embodiment of the mobile service vehicle of the present invention, said mast means is pivotably coupled to said vehicle proximate a rearmost end of said vehicle;

said vehicle at said rearmost end has attachment means thereon to permit attachment thereto of said platform member;

said platform member is adapted to allow a worker access to and to manually manipulate said hydraulic grasping means immediately above said well; and said attachment means adapted to support at least one side of said platform member so that said platform member is supported in a substantially raised, horizontal position when said mast means is in said second position.

In the above-preferred embodiment, the attachment means for attaching the platform to the rear of the rig comprises a plurality of vertically aligned apertures on the mast, to allow attachment of the platform member to the rig at various alternate heights. Removable pins, such as locking cotter pins may be used to removably attach the platform to the rear of the rig service vehicle of the present invention.

Not only is a well servicing vehicle having attachment means for attaching a platform member thereto disclosed herein, but a well servicing vehicle of the type described herein further having such platform attached thereto is further disclosed.

In a further broad aspect of the present invention, a mobile well servicing vehicle capable of carrying out each of the particular individual operations necessary to complete a well, include logging, swabbing, and insertion of jointed pipe into a well, including the step of perforating the well by conveying an explosive charge to a lowermost extremity of the well via the inserted pipe, is provided.

Accordingly, in a further aspect of this invention, a mobile well servicing vehicle is provided, adapted to conduct the individual steps of logging and swabbing of a pre-drilled well, and in addition the step of the inserting jointed, but not continuous, pipe into said well, further including the step of perforating the well by conveying an explosive charge to a lowermost extremity of the well via said inserted jointed pipe. Such vehicle, in such preferred embodiment, possesses:

elongate mast means, having a top end and a bottom end, pivotably coupled to said vehicle proximate said bottom end thereof, pivotable from a first substantially horizontal position to a second substantially vertical position;

engine means, for providing motive force for said vehicle via a transmission means;

hydraulic pump means coupled to said engine means, said engine means providing operative power to said hydraulic pump means;

a hydraulic piston member for raising said mast means from said first position to said second position;

hydraulically-operated telescoping levelling members situate at four substantially mutually opposite side corners of said vehicle;

a first hydraulically-powered winch means, situate proximate said top end of said mast means, for raising and lowering, via a cable member, a hydraulically-operated grappling means suspended via said cable member from said mast means, said grappling means adapted to grasp and manipulate said jointed pipe;

second hydraulically-powered winch means, situate on a bed of said vehicle, having cable means one end of which is wound thereon and another end thereof extending from said mast means, adapted to lower said jointed pipe via said cable means into said well; and third hydraulically-powered winch means, situate on said bed of said vehicle, having electrically conductive wire line means wound thereon, for lowering a well-logging device and a well swabbing means via said wire line means into said well;

wherein said hydraulic pump means supplies all necessary hydraulic power to each of said telescoping levelling members, said hydraulic piston member, said hydraulic grasping means, and each of said first, second, and third hydraulically-powered winch means.

Again, in a preferred refinement, capability is provided in the form of attachment means at the rear of the vehicle, to affix a platform member to the rear of such vehicle when the derrick is in the upright vertical position, to serve as a platform to allow one or more workers to manipulate the hydraulic power tongs when inserting the jointed pipe into the well or wellhead.

Accordingly, in such further embodiment of the present invention:

said mast means is pivotably coupled to said vehicle proximate a rearmost end of said vehicle;

said vehicle at said rearmost end having releasably engageable attachment means thereon to permit releasable attachment thereto of a raised platform member;

said raised platform member adapted to allow a worker access to and to manually manipulate said hydraulic grasping means immediately above said well; and said attachment means adapted to support at least one side of said platform member so that said platform is supported in a substantially horizontal position when said mast means is in said second position.

Likewise, the above preferred embodiment may, and preferably does, possess a plurality of substantially vertically-aligned apertures at the rear of the vehicle to allow attachment of said platform member to said vehicle at various alternate heights via said apertures. In this preferred embodiment, said apertures are located on said mast on exterior side edges thereof, in vertical, spaced apart, juxtaposed position.

BRIEF DESCRIPTION OF THE DRAWINGS

Further advantages and permutations will appear from the following detailed description of various non-limiting embodiments of the invention, taken together with the accompanying drawings, in which.

DETAILED DESCRIPTION OF SOME PREFERRED EMBODIMENTS

Figure 1:
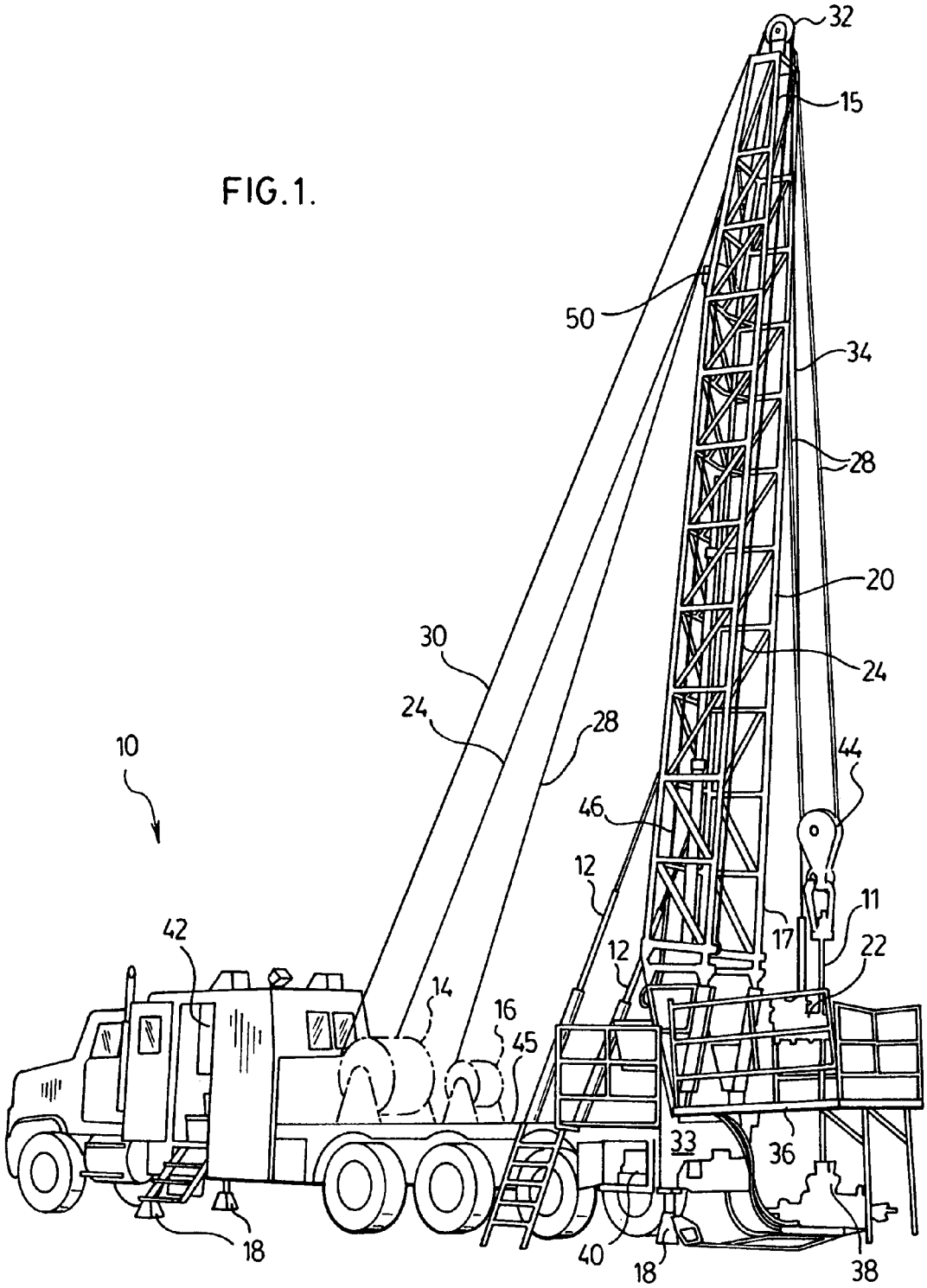
FIG. 1 is a perspective view of an embodiment of the mobile multi-function well servicing and completing vehicle of the present invention, in the operative position.

In all figures, for consistency, identical components are identified with identical reference numerals.

Figure 2:
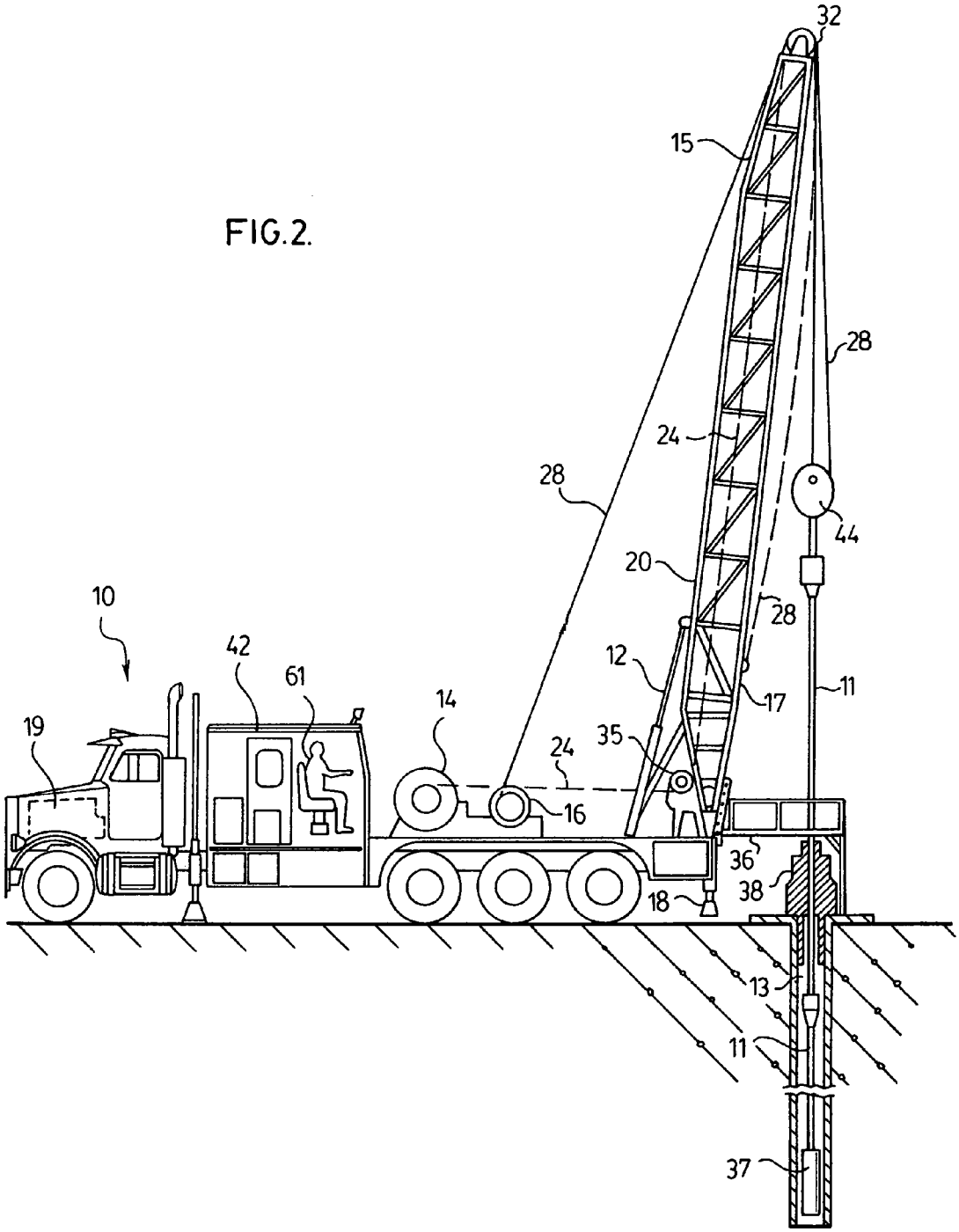
FIG. 2 is a side elevation view of the embodiment shown in FIG. 1, wherein the second winch is shown being used for injecting jointed pipe into the wellhead. The first winch, the cable extending from the first winch, and the attached hydraulically powered grappling means, has been omitted for clarity.
Figure 3:
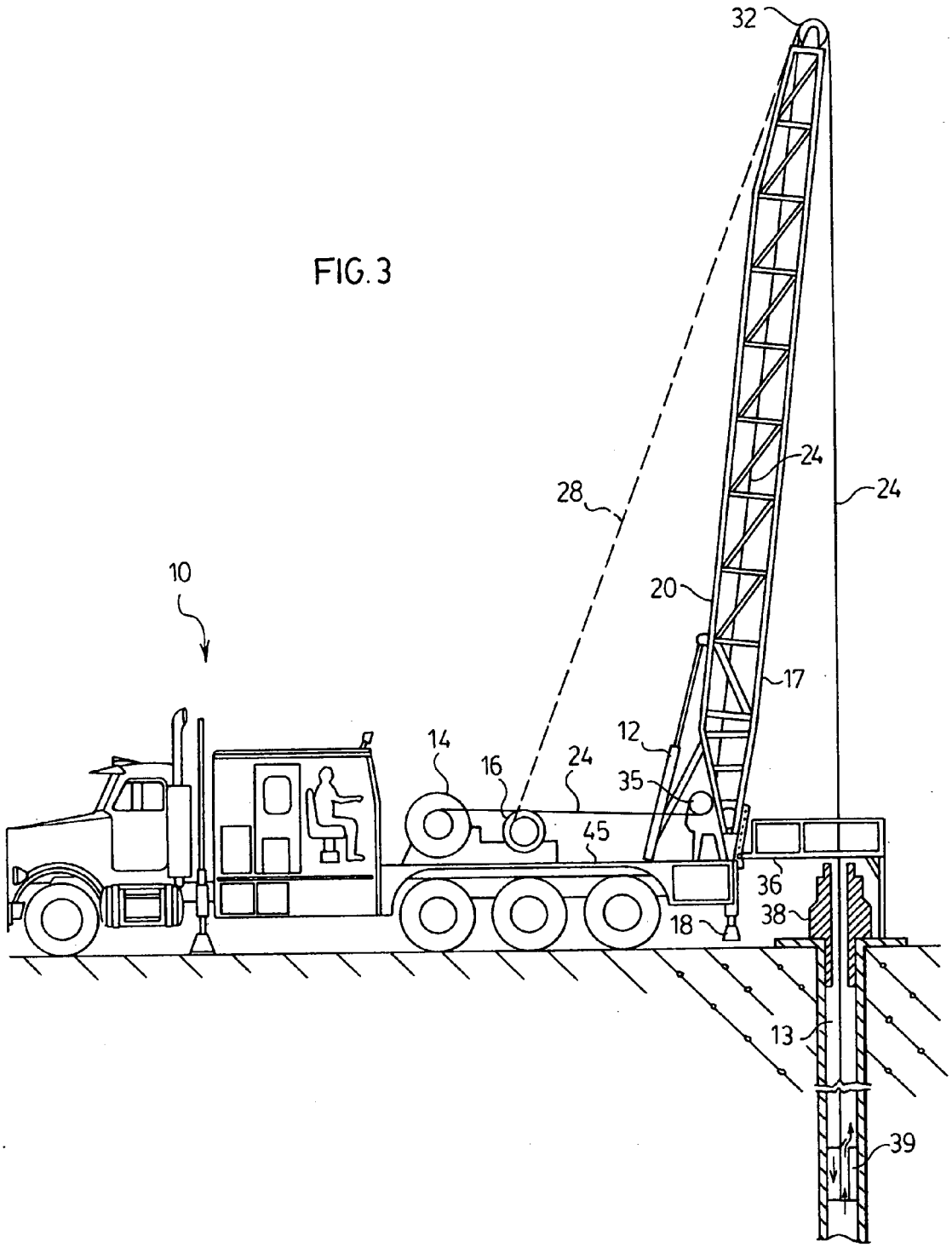
FIG. 3 is side elevation view similar to FIG. 2, wherein the third winch is being used for lowering a wireline into the well head for conducting swabbing operations. Again, for clarity, the first winch, the cable extending from the first winch, and the attached hydraulically powered grappling means, have been omitted for sake of clarity.

With reference to FIGS. 1-3, an embodiment of the mobile well servicing vehicle 10 of the present invention is shown. Vehicle 10 is adapted to conduct insertion of jointed pipe 11 into a well 13, and to further carry out at least one additional well-servicing step including logging, swabbing, and/or perforating of the inserted tubing 11.

Vehicle 10 possesses an elongate mast or derrick 20, having a top end 15 and a bottom end 17, which is pivotably coupled to the bed of the vehicle 10 proximate a rearmost end 33 of vehicle 10, as shown in FIGS. 1-3.

Figure 4:
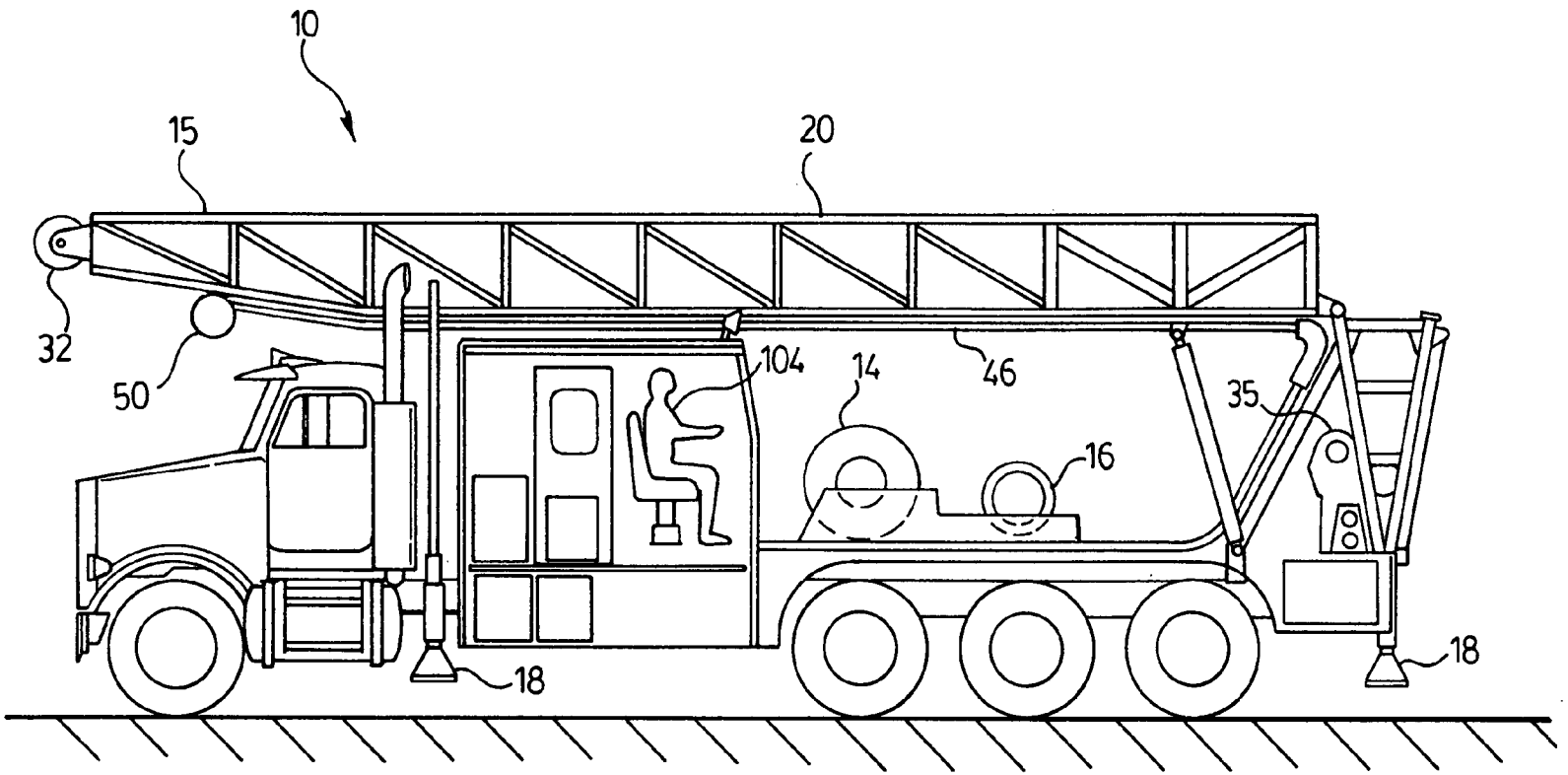
FIG. 4 is a side elevation view similar to FIGS. 2 & 3, showing the derrick in the collapsed position and the vehicle in its transport position.
Figure 5:
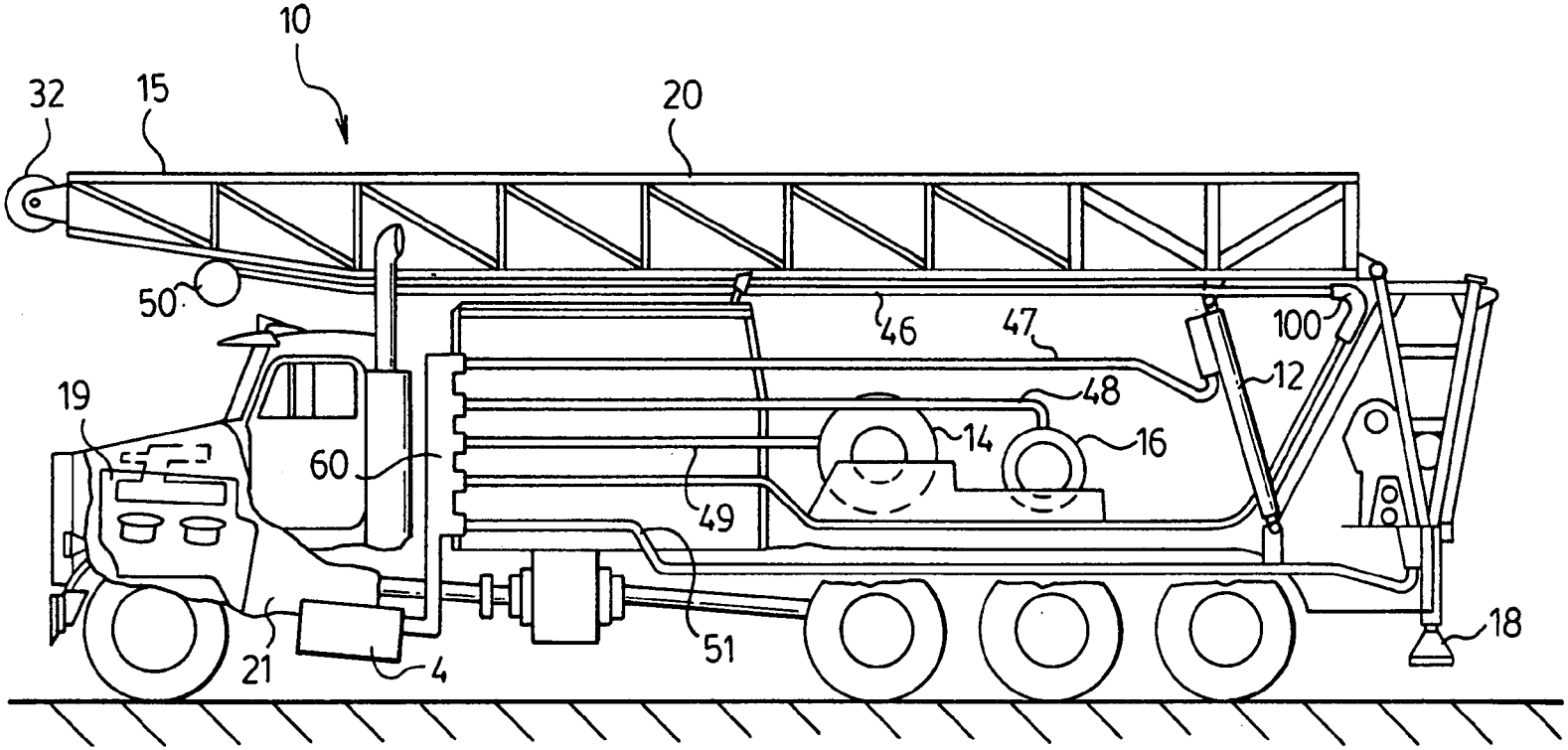
FIG. 5 is a schematic side elevation view, of the mobile rig vehicle of the present invention, in partial cutaway, showing location of the hydraulic pump, and schematically connection of the pump to the rear telescoping jacks, the hydraulic cylinders for raising the derrick, and to the first, second, and third winches (the connection to the hydraulic pipe grappling means has been omitted for clarity)

Derrick 20 is pivotable from a substantially horizontal transport position, as shown in each of FIGS. 4 & 5, to a substantially vertical operable position, as shown in FIGS. 1-3, by means of two hydraulic pistons 12 which serve to raise and lower derrick 20. Because derrick 20 may in some cases be used in a slightly over-vertical position as shown in FIGS. 1-3, in a preferred embodiment each of such pistons 12 are of the double-acting type, wherein such pistons 12 may excert not only a raising force to raise derrick 20 to an over-vertical position, but also a retracting force to bring derrick 20 from an over-vertical position to a vertical position, and finally to a lowered position suitable for when the vehicle 10 need transport derrick 20 and associated additional equipment described below to another wellsite.

Vehicle 10 possesses an engine 19, coupled to the vehicle transmission 21, for providing the motive force for moving vehicle 10 and transporting derrick 20.

A conventional hydraulic pump 21 provides pressurized hydraulic fluid to, inter alia, hydraulic pistons 12 and other additional equipment, as described below. Such hydraulic pump 21 is any conventional hydraulic pump commonly available, with suitable pressure and flow capabilities, such as the Sauer Danfoss model #A-04-50-02526 05-06-87635 hydraulic pump.

Hydraulic pump 21 is preferably mounted on transmission 21, as shown in FIG. 5, and mechanically coupled to vehicle engine 19 by means of a splined power take off shaft (not shown) protruding from vehicle transmission 21.

In preferred embodiment, vehicle 10 maybe a truck of the type made by Navistar International Corporation of Warrenville, Ill., model 5600 "paystar", having triple rear axles which are preferable to support weight of derrick 20. Transmission 21 on such model of truck (see FIG. 5) possesses two power take off shafts (not shown) extending from transmission 21, to which hydraulic pump 4 may be mechanically coupled to one of said shafts (not shown). In a preferred embodiment, model #A-04-50-02526 05-06-87635 of hydraulic pump 4 manufactured by Sauer Danfoss is mechanically coupled to one of said splined pto shafts.

A first hydraulically-powered winch 50 is provided, mounted on proximate the crown 15 of derrick 20, whose function is explained below.

A second hydraulically-powered winch 14 situated on bed 45 of vehicle 10 is also provided, adapted to raise and lower joined pipe 11 into well 13 and to hold lengths of inserted pipe 11 during coupling of jointed pipe 11 together. Second winch 14 has a cable 28, one end of which is wound thereon and another opposite end extends around shieve 32 located proximate the crown 15 of derrick 20, and finally around a second shieve 44, so as to provide a mechanical lifting advantage to such winch 14 in a known manner.

First winch 50 is used to raise and lower hydraulically-operated grappling means in the form of hydraulically-operated power tongs 22, which are used by workmen, preferably standing on platform 36, to grasp and threadably connect lengths of jointed tubing 11 together. Winch 50 is used to raise or lower power tongs 22 to the desired height above platform 36 for convenient use by the workmen. As the height of platform 36 may vary, as described below, due to varying height of well-head 38 due to various sized blow-out preventers, winch 50 is provided to permit raising or lowering of power tongs 22 to a desired height above platform 36 that is convenient for workmen to operate such tongs 22 to threadably attach the jointed pipe 11 during insertion of such pipe into well 13.

The insertion of lengths of jointed pipe 11 in well 13 involves inserting a first initial length of jointed pipe 11 into a well-head 38, and thereafter threadably attaching a lower end of a further length of pipe 11 to a protruding top end of initial pipe 11. The process is repeated until an entire jointed pipe tubing string is inserted into well 13, namely until sufficient tubing 11 is lowered to reach the bottom of well 13.

When carrying out the pipe joining and insertion operation, cable 28 and derrick 20 must temporarily lift, or at least hold in position, the length of continuously jointed tubing 11 that has been inserted in well 13 to that point in time. This means that for shallow well depths of 1,500 meters, where jointed pipe of 2⅜" diameter is used, cable 28 and derrick 20 need support approximately 23,000 lbs of tubing. Requisite safety factors typically mean, for drill depths of 1,500 meters, that derrick 20 must be designed to support at least 30,000 lb.

Likewise for jointed pipe of greater diameter, say 2⅞" for well depths of 1,000 meters, derrick 20 must be designed to support at least 22,000 lbs.

Figure 6:
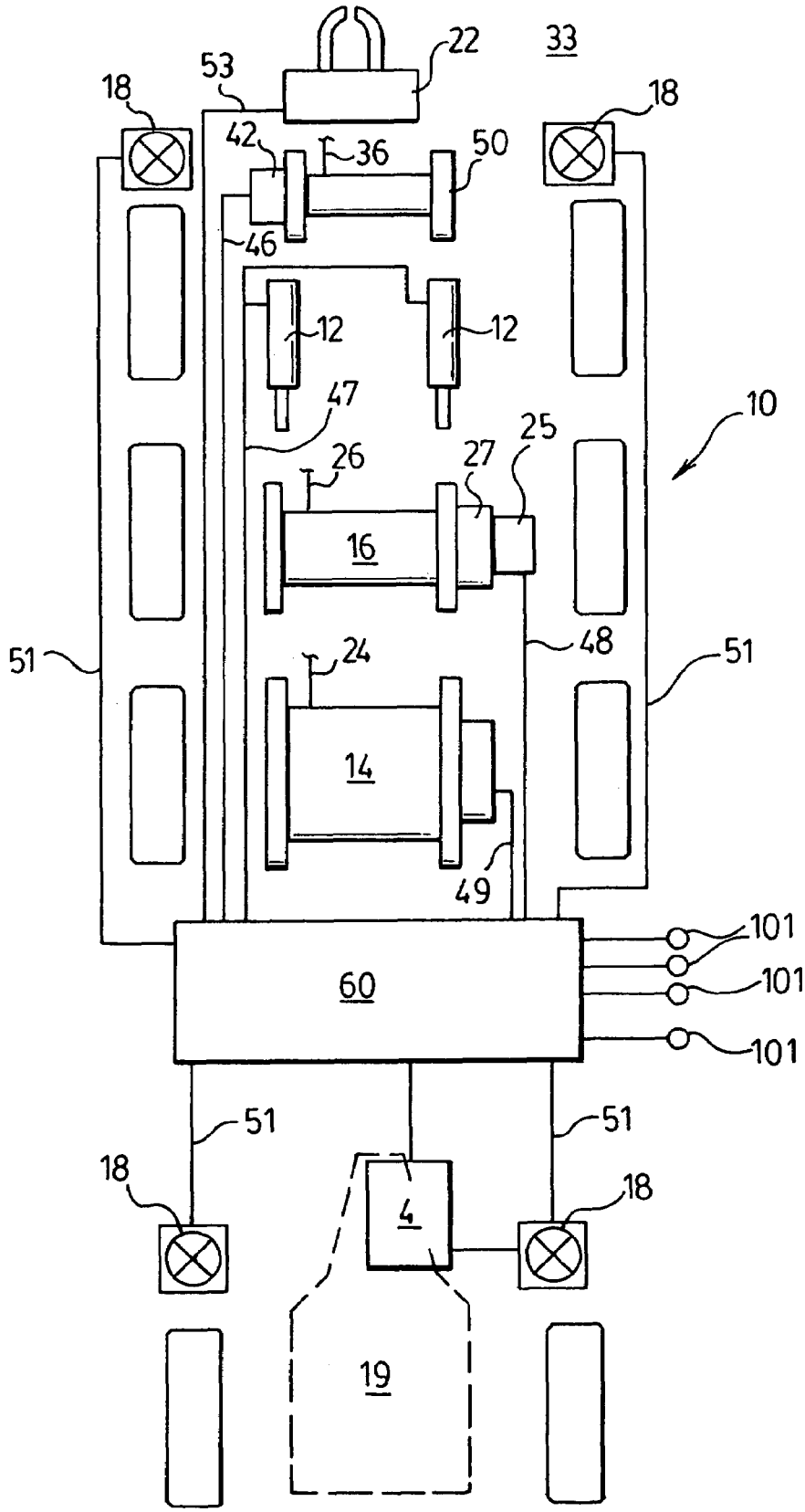
FIG. 6 is a simplified schematic, showing in plan view of the vehicle the hydraulic connections from the hydraulic pump to respectively each of the first, second, and third winches, each of the four telescoping jacks, each of the hydraulic raising pistons, and the single hydraulically operated pipe-grappling means.

Due to mechanical advantages incorporated by use of shieves 32 and 44, while cable 28 need support of 30,000 lbs tension, winch 16 due to various mechanical advantages provided by shieve 32 and 44 need typically only exert a force of typically ¼ such maximum tension, typically 7,500 lbs, which may even be reduced further if winch 14 is connected via reduction gearing 27 to a hydraulic motor 25, as shown schematically In FIG. 6.

A third hydraulically-powered winch 14 has wound thereon conductive wireline 24, for lowering a well-logging instrument (not shown) into the well 13 to obtain well data. Such well data from the lowered well-logging instrument is recorded by logging instruments contained in an operators enclosure 42 resting on bed 45 of service vehicle 10 (see FIG. 3).

In preferred embodiment, for logging operation, conductive wireline 24 extending from winch 14 is first passed around a portion of shieve 35 and thence to shieve 32 on crown 15 of derrick 20, and thereafter downwardly into well 13, as shown in FIG. 3, rather than directly to shieve 32 and thereafter downwardly into well 13, as shown in FIG. 1. Shieve 35 is coupled to monitoring equipment such that measured rotation of shieve 35 occurs during lowering of a logging instrument into well 13, in order that precise measurement of the depth of such logging instrument within well 13 is known. Such allows for data received from the logging instrument (not shown) at the end of conductive wireline 24 to be precisely correlated to depth measurements determined from the number of rotations of shieve 35 corresponding to the amount of conductive wireline "played out" by winch 14, by data recording instruments provided in operator's enclosure 42.

In a preferred embodiment of the present invention a single hydraulic pump 4 (see FIG. 5) is coupled to vehicle transmission 21, namely to a pto shaft thereof, and provides pressurized hydraulic fluid to permit operation of each of hydraulic pistons 12, power tongs 22, levelling jacks 18, and each of winches 14, 16, and 50. Multi-stage hydraulic pumps, or a plurality of hydraulic pumps, may be used depending on whether a single pump can meet the necessary pressure of volume of hydraulic fluid required to operate individually all of the aforesaid hydraulic pistons 12, power tongs 22, levelling jacks 18, and each of winches 14, 16, and 50.

In the case of winches 14, 16 and 50, each are further provided with a respective hydraulic motor, namely hydraulic motors 15, 25, and 49 (see FIG. 5) to receive pressurized hydraulic fluid from pump 4 and convert same into mechanical force to power each of respective third, second and first winches 14, 16, and 50.

Hydraulic control means, identified schematically as item 60 in FIG. 5 and 6, is provided to allow individual hydraulic control of raising and lowering of derrick 20 via pistons 12, levelling of service vehicle 10 by means of individual control of levelling jacks 18, operation of power tongs 22, and independent operation of each of winches 14, 16, and 50.

As best seen in FIGS. 5 and 6, hydraulic supply lines 46, 47, 48, 49, 51 and 53 extend from hydraulic control means 60 to respectively each of first winches 50, hydraulic pistons 12, second winch 16, third winch 14, and levelling means 18.

Hydraulic control means 60 is further provided a number of individual controls 101, to control each of hydraulic supply lines 46, 47, 48, 49, 51 and 53, and may be duplicated so as to provide ease of access to operators at various points on service vehicle 10. For example, a first set of hydraulic controls 60 may be situated within operator's enclosure 42. A duplicate of subset of such controls 60 may, in addition or alternatively, be located proximate the rear most portion 33 of service vehicle 10 at location designed as item 40 (see FIG. 1), to permit service operator 104 to control the various winches 14, 16 and 50 and the raising of derrick 20, from a position closer to wellhead 38.

Likewise, an individual set of hydraulic controls 60 may be situated on derrick 20 at a raised position of the rear most portion 33 of service vehicle 10, to give workmen standing on platform 36 the ability to control power tongs 22 (see FIG. 1) on an as-needed basis when manipulating and joining jointed pipe 11.

In a preferred embodiment, although mechanical advantages by use of shieves 32 and 44 may be obtained to lower, hold, and in some cases raise, lengths of jointed pipe 11 into and out of well 13 by winch 16, frequently additional mechanical advantage is needed to raise, by such winch means 16, successive lengths of jointed pipe 11.

Accordingly, in a preferred embodiment as best seen in FIG. 6, hydraulic motor 25 of winch 16 is coupled to winch 16 by means of reduction gearing, in order to ensure winch 16 has the mechanical strength to raise what in some cases may be 23,000 lb of jointed pipe 11 (see FIG. 6). In the preferred embodiment shown in FIG. 6, planetary reduction gears 27 are interposed between hydraulic motor 25 and winch 16, in order to ensure winch 16 has the mechanical strength to raise, if necessary, such weight of jointed pipe 11.

Hydraulic motors 49 and 47 are likewise provided to power respectively first winch 50, and third winch 14. However, due to lesser loading on each of winches 50 and 14 as compared to winch 16, additional reduction gearing is not typically needed, but may be provided if needed.

A safety guy wire 30, as shown in FIG. 1, is preferably provided, to prevent derrick 20 going to a substantially over-vertical position and falling to the ground and injuring workmen in the event of failure of hydraulic pistons 12 and/or hydraulic pump 4.

In a preferred embodiment of the well servicing vehicle 10 of the present invention, releasably engageable attachment means 59 is provided at the rear most end 33 of service vehicle 10, to permit releasable attachment of a platform member 36, to allow a worker at a well site raised access to power tongs 22 immediately above wellhead 38, for the purposes of being able to use such tongs 22 to threadable engage lengths of jointed pipe 11 when inserting such jointed pipe 11 into well 13.

Attachment means 59, in a preferred embodiment, comprises of plurality of substantially vertically-aligned apertures 61 on derrick 20, preferably in the form of a plate member 63 bolted or welded thereto having a series of vertically-aligned apertures 61 therein to allow releasable attachment of platform number 36 thereto at various alternate heights, dependent on the height of wellhead 38.

Figure 7A:
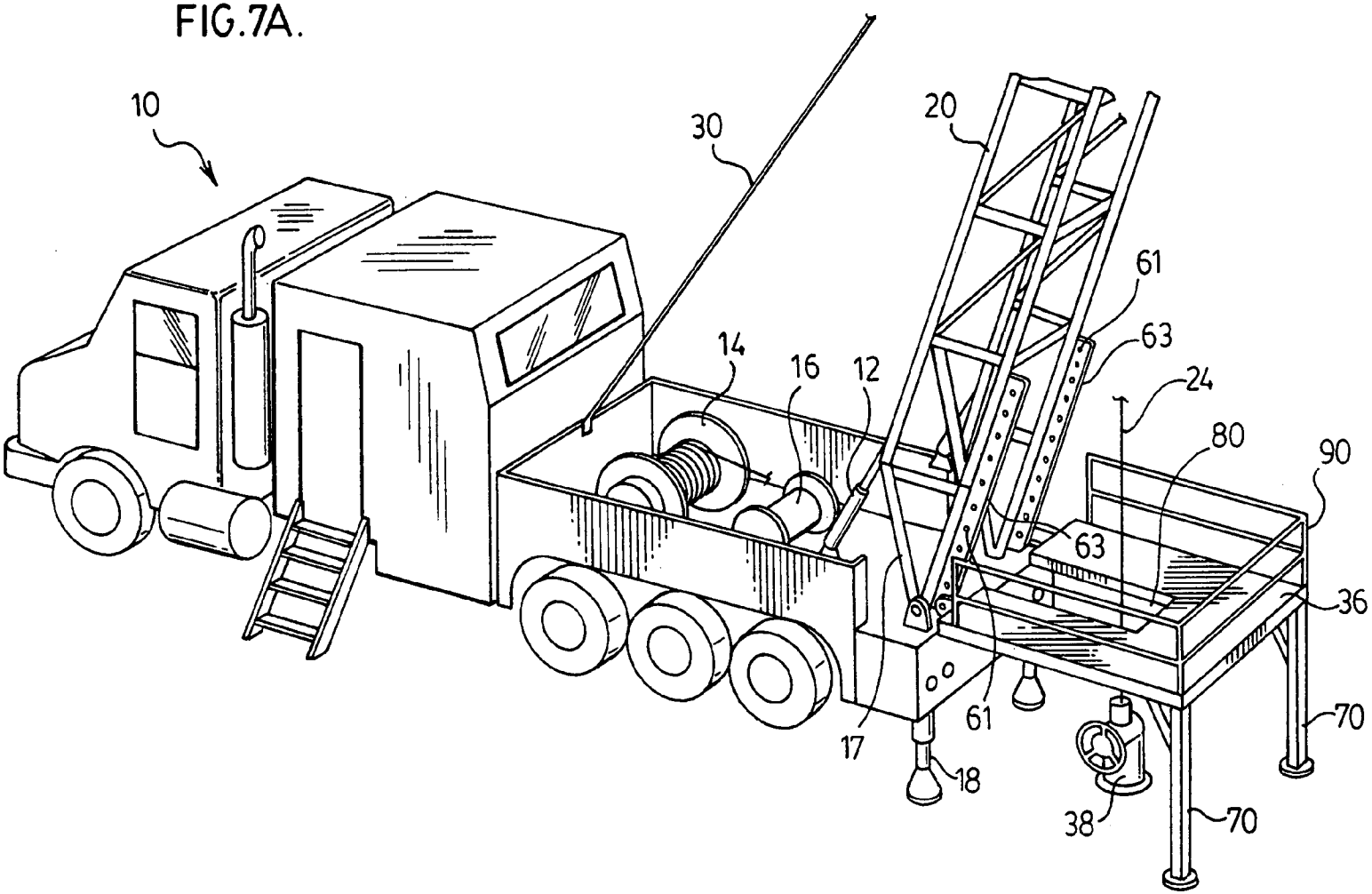
FIG. 7A is a rear perspective view of a preferred embodiment of the mobile rig of the present invention, having attachment means at the rear of such vehicle for a platform member, the platform member being shown attached in a first selected raised position.
Figure 7B:
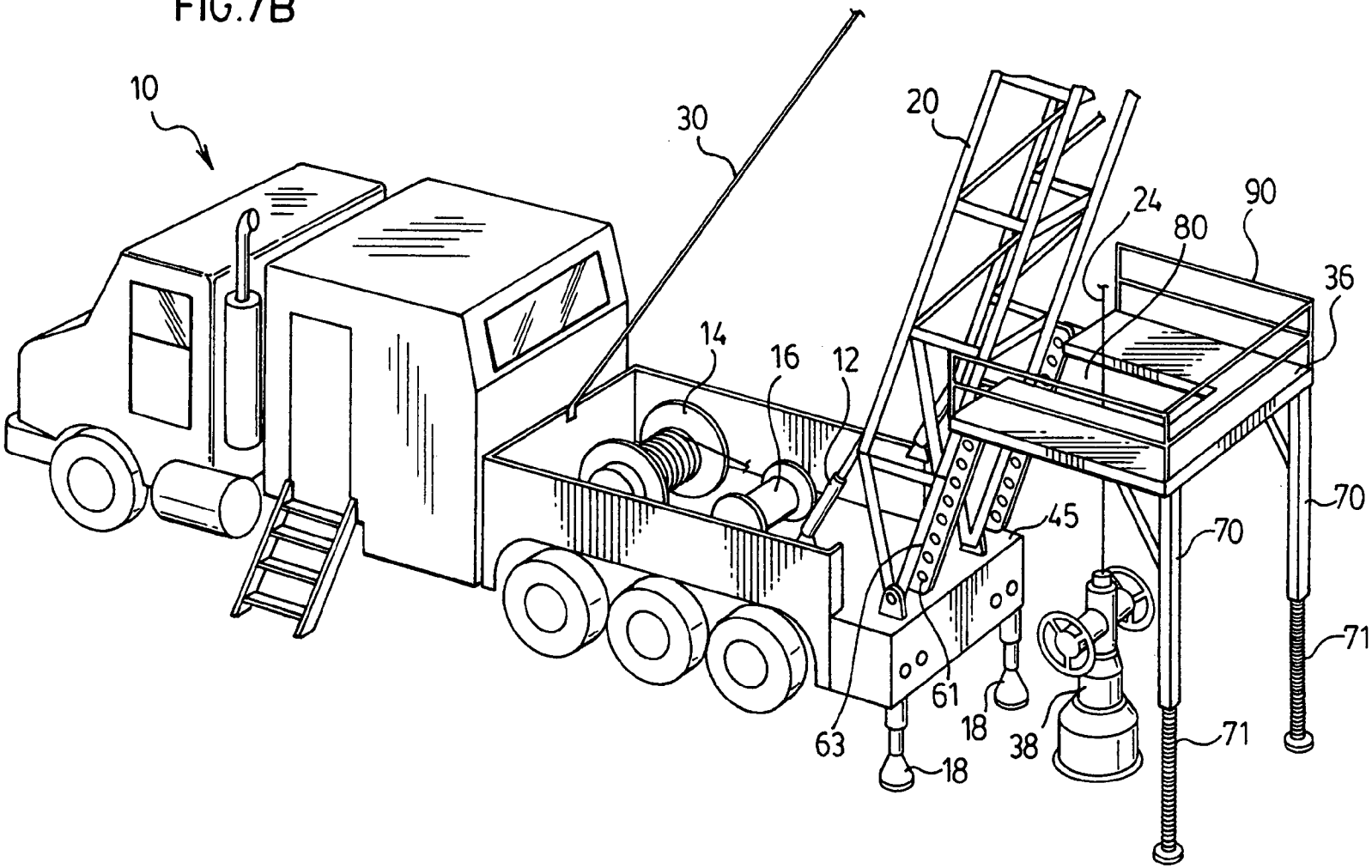
FIG. 7B is a rear perspective view of a preferred embodiment of the mobile rig of the present invention shown in FIG. 7A, showing the same embodiment of the platform member, but with such platform member attached in a second selected raised position.

Specifically, by having a number of vertically aligned apertures 61 in plate member 63, platform member 36 may be removably attached via said attachment means 59 at a first height above well-head 38, as shown in FIG. 7A, or may be attached at a second (higher) height above the ground, as shown is FIG. 7B, to accommodate larger (higher) wellheads 38.

It is intended that platform member 36 be coupled to the attachment means 59 on derrick 20 by hinge members 82 along a side edge 65 thereof. In order to ensure platform member 36 is capable of being level regardless of the height at which it is releasibly affixed with the attachment means 59 to service vehicle 10, telescoping legs 70 are provided to assist In ensuring the platform 36 remains horizontal.

In a preferred embodiment, each of telescoping legs 70 may be individually adjusted, by means of adjustable screw jacks 71, to account for uneven terrain around wellhead 38, so that platform 36 is substantially horizontal when in the operative position and releasibly attached to vehicle 10.

In the embodiment shown in FIGS. 7A and B, platform 36 is of a 'C' shape to provide a 'C' shaped "catwalk" about an aperture 80 facing forwardly towards a front end of vehicle 10, to permit jointed pipe 11 to extend down from mast 20 through platform 36 to wellhead 38.

Alternatively, aperture 80 in platform member 36 may face rearward, as shown in FIG. 8, again providing a 'C' shaped platform 36 for workers to utilize power tongs 22 about wellhead 38, when inserting jointed pipe 11 into wellhead 38.

Figure 8:
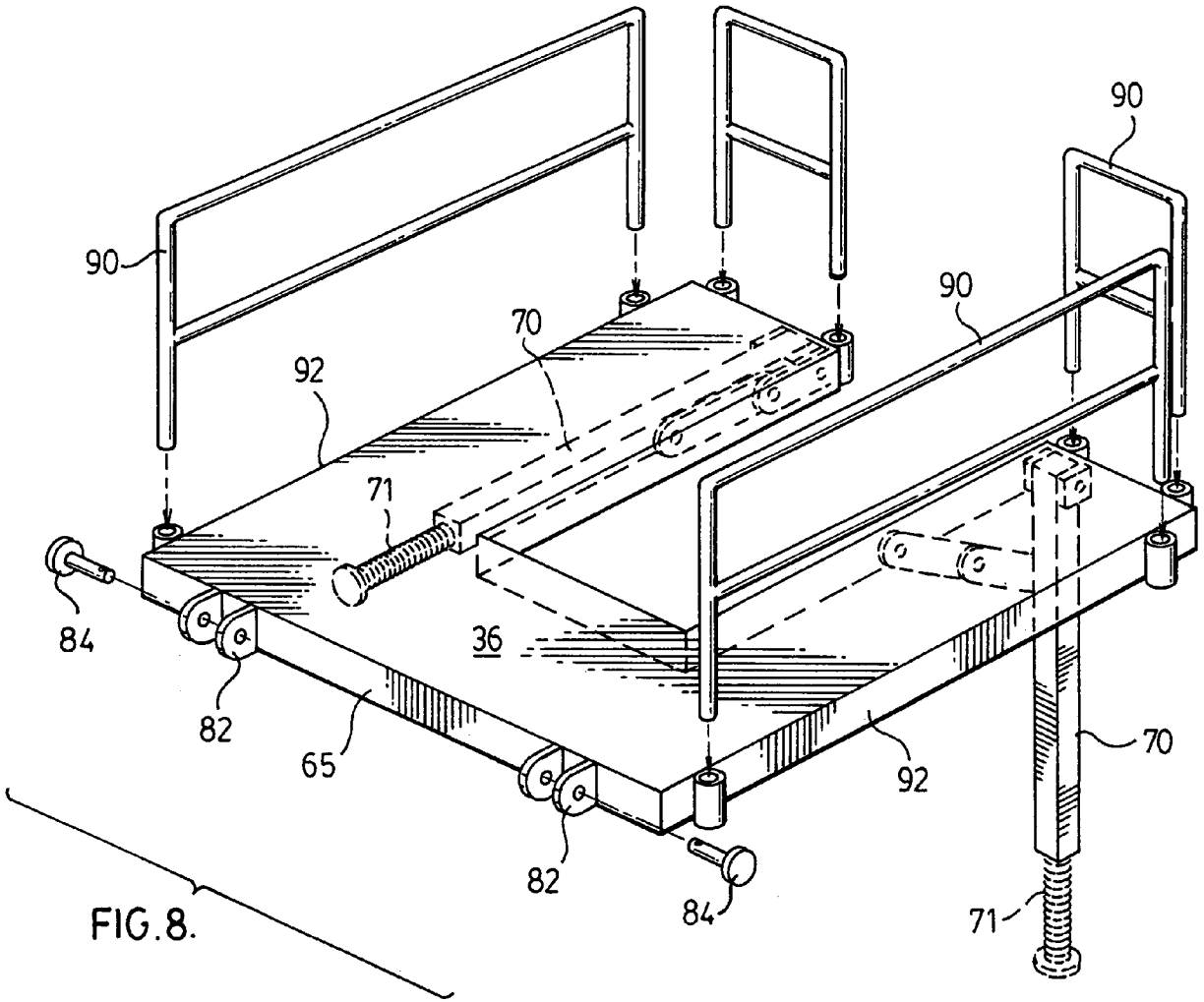
FIG. 8 is a detailed view of another embodiment of the platform of the present invention, which is attachable to the mobile rig vehicle of the present invention.

FIG. 8 shows a detailed perspective view of collapsible releasable platform member 36. A series of hinge members 82, releasibly attachable to plate members 63 by means of bolts or locking cotter pins 84, are provided to permit releasable engagement of platform member 36 with service vehicle 10.

Advantageously, each of telescoping supporting legs 70 are preferably pivotably collapsible on underside of platform member 36, as shown in FIG. 8, so that when such platform member 36 is no longer needed and releasibly detached from the rear of vehicle 10, supporting legs 70 may be easily collapsed and platform 36 may then be easily transported on another vehicle to another well site. Advantageously, therefore, vehicle 10 need not further transport platform member 36 to such other well site.

Releasibly-detachable guardrails 90, releasibly attachable to side edges 92 of platform 36 as shown in FIG. 8, are preferably provided, which in the installed position provide a safety guard to workman working on such platform 36 when platform 36 is in a raised, operative position.

Advantageously, winches 50 and/or 15 and associated respective cables 34 and 24 may be used to raise platform member 36 to a raised position at which it may be affixed to vehicle 10 by attachment means 59 and hinge members 82.

Although the disclosure described and illustrates preferred embodiments of the invention, it is to be understood that the invention is not limited to these particular embodiments. Many variations and modifications will now occur to those skilled in the art. For definition of the invention, reference is to be made to the appended claims.

We claim:

1. A mobile well servicing vehicle adapted to conduct the steps of logging and swabbing of a pre-drilled well and in addition insertion of jointed, but not continuous, pipe into said well, including the step of perforating the well by conveying an explosive charge to a lowermost extremity of the well via said inserted jointed pipe, comprising:

elongate mast means, having a top end and a bottom end, pivotably coupled to said vehicle proximate said bottom end thereof, pivotable from a first substantially horizontal position to a second substantially vertical position;

engine means, for providing motive force for said vehicle via a transmission means;

hydraulic pump means coupled to said engine means, said engine means providing operative power to said hydraulic pump means;

a hydraulic piston member for raising said mast means from said first position to said second position;

hydraulically-operated telescoping levelling members situate respectively at four substantially mutually opposite side corners of said vehicle;

a first hydraulically-powered winch means, situate proximate said top end of said mast means, for raising and lowering, via a cable member, a hydraulically-operated grappling means suspended via said cable member from said mast means, said grappling means adapted to grasp and manipulate said jointed pipe;

second hydraulically-powered winch means, situate on a bed of said vehicle, having cable means one end of which is wound thereon and another end thereof extending from said mast means, adapted to lower said jointed pipe via said cable means into said well; and third hydraulically-powered winch means, situate on said bed of said vehicle, having electrically conductive wire line means wound thereon, for lowering a well-logging device and a well swabbing means via said wire line means into said well;

wherein said hydraulic pump means supplies all necessary hydraulic power to each of said telescoping member, said hydraulic piston member, said hydraulic grasping means, and each of said first, second, and third hydraulically-powered winch means.

2. A mobile well-servicing vehicle as claimed in claim 1, wherein said hydraulic pump means comprises a single hydraulic pump.

3. A mobile well-servicing vehicle as claimed in claim 1 wherein said hydraulic pump means is in fluid communication with hydraulic motor means, and said hydraulic motor means is directly coupled, via a planetary gear reduction arrangement, to said second winch means.

4. A mobile well-servicing vehicle as claimed in claim 1 wherein said mast means is pivotably coupled to said vehicle proximate a rearmost end of said vehicle;

said vehicle at said rearmost end having releasably engageable attachment means thereon to permit releasable attachment thereto of a raised platform member;

said raised platform member adapted to allow a worker access to and to manually manipulate said hydraulic grasping means immediately above said well; and said attachment means adapted to support at least one side of said platform member so that said platform is supported in a substantially horizontal position when said mast means is in said second position.

5. A mobile well servicing vehicle as claimed in claim 4, said attachment means comprising a plurality of substantially vertically-aligned apertures to allow attachment of said platform member to said vehicle via said apertures at various alternate heights.

6. A mobile well servicing vehicle adapted to conduct insertion of jointed, but not continuous, pipe into a predrilled well, including conducting at least one additional well-servicing step selected from the group of well servicing steps of logging, swabbing, and perforating, comprising:

elongate mast means, having a top end and a bottom end, pivotably coupled to said vehicle proximate said bottom end, pivotable from a first substantially horizontal position to a second substantially vertical position;

engine means, for providing motive force for said vehicle via a transmission means;

hydraulic pump means, coupled to said engine means, said engine means providing operative power to said hydraulic pump means;

hydraulic piston member, hydraulically coupled to said hydraulic pump means, for raising and lowering said mast means from said first position to said second position, and from said second position to said first position, respectively;

hydraulically-operated telescoping levelling members situate at respectively substantially mutually opposite side corners of said vehicle, each hydraulically coupled to said hydraulic pump means;

a first hydraulically-powered winch means, hydraulically coupled to said hydraulic pump means, situate proximate said top end of said mast means, for raising and lowering, via a cable member, a hydraulically-operated grappling means suspended via said cable member from said mast means, said grappling means adapted to grasp and manipulate said jointed pipe, said grappling means hydraulically coupled to said pump means;

a second hydraulically-powered winch means, hydraulically coupled to said hydraulic pump means, having cable means wound thereon to permit lowering of said jointed pipe via said cable means into said well; and a third hydraulically-powered second winch means, hydraulically coupled to said hydraulic pump means, having electrically conductive wire line means wound thereon, for lowering one or more devices selected from the group of devices comprising a well-logging device and a well swabbing device, via said second cable means, into said well.

7. A mobile well servicing vehicle as claimed in claim 6, wherein said hydraulic pump means comprises a single hydraulic pump.

8. A mobile well-servicing vehicle as claimed in claim 6 wherein said hydraulic pump means is in fluid communication with hydraulic motor means, and said hydraulic motor means is directly coupled, via a planetary gear reduction arrangement, to said second winch means.

9. A mobile well-servicing vehicle as claimed in claim 6, wherein said mast means is pivotably coupled to said vehicle proximate a rearmost end of said vehicle;

said vehicle at said rearmost end having attachment means thereon to permit attachment thereto of a platform member;

said platform member adapted to allow a worker access to and to manually manipulate said hydraulic grasping means immediately above said well; and said attachment means adapted to support at least one side of said platform member so that said platform member is supported in a substantially raised, horizontal position when said mast means is in said second position.

10. A mobile well servicing vehicle as claimed in claim 9, said attachment means comprising a plurality of vertically-aligned apertures to allow attachment of said platform member to said vehicle at various alternate heights.

11. A mobile well servicing vehicle adapted to conduct insertion of jointed, but not continuous, pipe into a predrilled well, including conducting at least one additional well-servicing step selected from the group of well servicing steps consisting of logging, swabbing, and perforating, in combination with a platform member, comprising:

elongate mast means, having a top end and a bottom end, pivotably coupled to said vehicle proximate said bottom end of said mast means proximate a rearmost end of said vehicle, pivotable from a first substantially horizontal position to a second substantially vertical position;

engine means, for providing motive force for said vehicle via a transmission means;

hydraulic pump means, coupled to said engine means, said engine means providing operative power to said hydraulic pump means;

hydraulic piston member, hydraulically coupled to said hydraulic pump means, for raising and lowering said mast means from said first position to said second position, and from said second position to said first position, respectively;

four hydraulically-operated telescoping levelling members situate respectively at four substantially mutually opposite side corners of said vehicle, each hydraulically coupled to said hydraulic pump means;

a first hydraulically-powered winch means, hydraulically coupled to said hydraulic pump means, situate proximate said top end of said mast means, for raising and lowering, via a cable member, a hydraulically-operated grappling means suspended via said cable member from said mast means, said grappling means adapted to grasp and manipulate said jointed pipe, said grappling means hydraulically coupled to said pump means;

a second hydraulically-powered winch means, hydraulically coupled to said hydraulic pump means, having cable means wound thereon to permit lowering of said jointed pipe via said cable means into said well;

a third hydraulically-powered winch means, hydraulically coupled to said hydraulic pump means, having electrically conductive wire line means wound thereon, for lowering one or more devices selected from the group of devices comprising a well-logging device and a well swabbing device, via said wire line means, into said well;

attachment means at said rearmost end of said vehicle to permit attachment thereto of said platform member;

said platform member adapted to allow a worker access to and to manually manipulate said hydraulic grasping means immediately above said well; and said attachment means adapted to support at least one side of said platform member so that said platform is supported in a substantially horizontal position when said mast means is in said second position.

12. A mobile well servicing vehicle as claimed in claim 11, said attachment means comprising a plurality of vertically-aligned apertures to allow attachment of said platform member to said vehicle at various alternate heights.

13. A mobile well servicing vehicle as claimed in claim 11, said platform member having a plurality of telescoping leg members pivotably coupled to said platform member, adjustable to various lengths, each leg member pivotably collapsible to an underside of said platform member when said platform is detached from said vehicle.

* * * * *